United States Patent [19]

Lotter

[11] 4,382,399

[45] May 10, 1983

[54] SUPPORT FOR THE DRIVE SHAFT OF AN AXIAL-PISTON MACHINE OF AN INCLINED AXIS CONSTRUCTION

[75] Inventor: Manfred Lotter, Neu-Ulm, Fed. Rep. of Germany

[73] Assignee: Hydromatik GmbH, Fed. Rep. of Germany

[21] Appl. No.: 209,473

[22] Filed: Nov. 24, 1980

[30] Foreign Application Priority Data

Nov. 26, 1979 [DE] Fed. Rep. of Germany ..... 2947553

[51] Int. Cl.[3] ..... F01B 13/04

[52] U.S. Cl. ..... 91/486; 91/499

[58] Field of Search ..... 91/486–488, 91/499, 507

[56] References Cited

U.S. PATENT DOCUMENTS

| | | | |
|---|---|---|---|
| 3,721,161 | 3/1973 | Bobst | 91/499 |
| 3,789,740 | 2/1974 | Boyer | 91/486 |
| 3,862,588 | 1/1975 | Bahrle | 91/486 |

FOREIGN PATENT DOCUMENTS

| | | | |
|---|---|---|---|
| 2151934 | 8/1973 | Fed. Rep. of Germany | 91/499 |
| 189313 | 12/1966 | U.S.S.R. | 91/499 |

*Primary Examiner*—William L. Freeh

*Attorney, Agent, or Firm*—Scully, Scott, Murphy & Presser

[57] ABSTRACT

A support for the drive shaft of an axial-piston machine of inclined axis construction (pivoted or tilted drum) for pressurized fluids, consisting of at least one axially loadable bearing arranged at respectively, the piston side and at the drive side with stationary outer rings arranged in a bearing housing and a load-receiving direction located the same towards the piston side. At least the outer ring of one of the bearings is axially supported on the bearing housing and at least one of the inner rings of the bearing is supported on the drive shaft at the piston side shaft and whereby, for balancing the axial components of the piston forces effective between the bearings, there is provided at least one pressure cylinder unit with a balancing piston which is acted upon with pressurized fluid from the pressure side of the machine.

5 Claims, 1 Drawing Figure

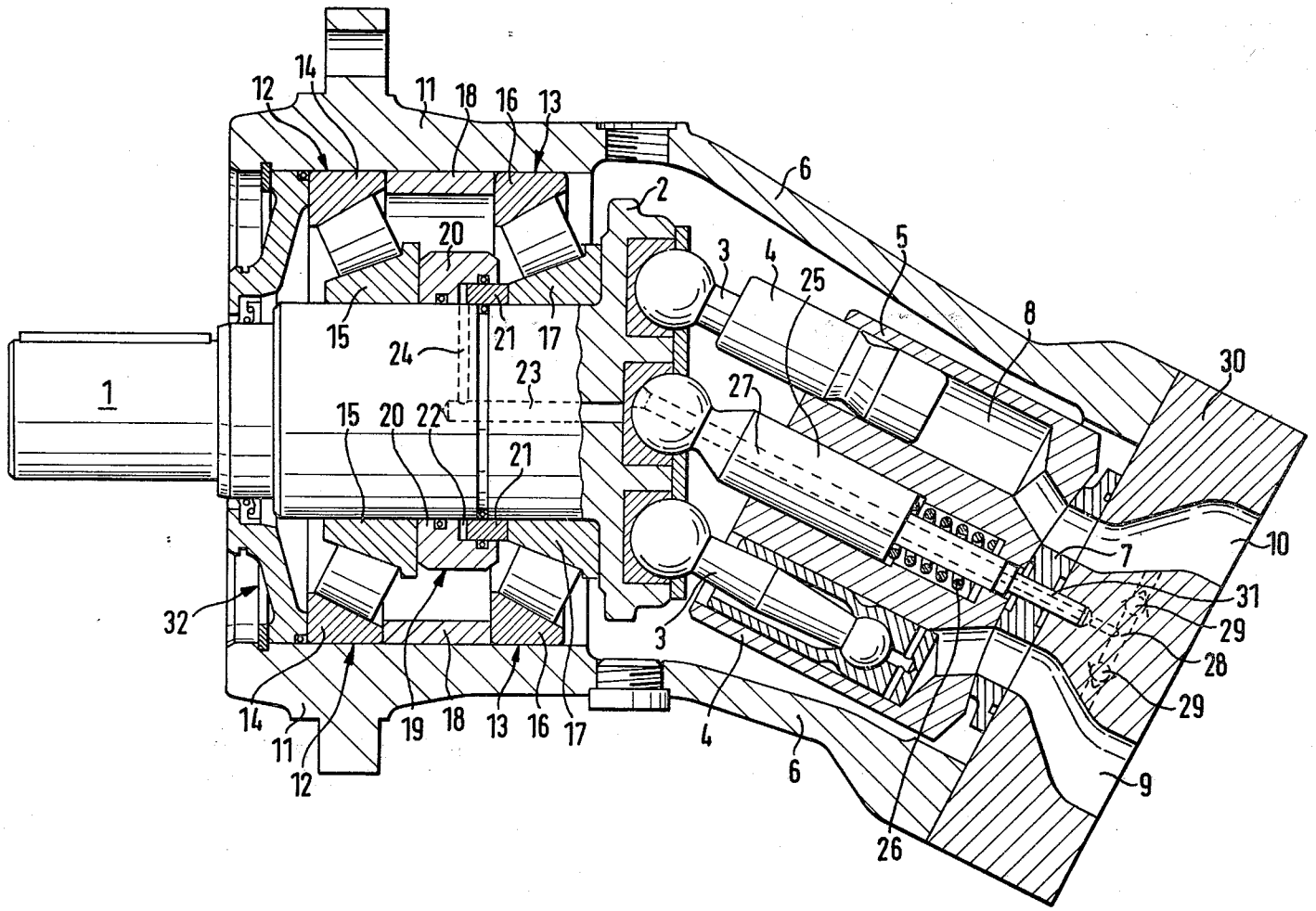
30
10
31
29
28
29
9
7
8
5
6
25
4
3
27
2
26
6
4
3
13
16
18
11
17
21
23
21
17
16
13
18
19
20
24
22
20
15
15
14
12
11
12
14
32
1

SUPPORT FOR THE DRIVE SHAFT OF AN AXIAL-PISTON MACHINE OF AN INCLINED AXIS CONSTRUCTION

BACKGROUND OF THE INVENTION

1. Field of the Invention

The present invention relates to a support for the drive shaft of an axial-piston machine of inclined axis construction (pivoted or tilted drum) for pressurized fluids, consisting of at least one axially loadable bearing arranged at respectively, the piston side and at the drive side with stationary outer rings arranged in a bearing housing and a load-receiving direction located the same towards the piston side. At least the outer ring of one of the bearings is axially supported on the bearing housing and at least one of the inner rings of the bearing is supported on the drive shaft at the piston side shaft and whereby, for balancing the axial components of the piston forces effective between the bearings, there is provided at least one pressure cylinder unit with a balancing piston which is acted upon with pressurized fluid from the pressure side of the machine.

The drive shaft support of inclined-axis axial-piston machines has to transmit primarily axial forces. Hereby one usually intends to distribute these forces over a plurality of parallel operating bearings whereby, however, a uniform load distribution which requires an extraordinarily precise coordination in effect, over the entire load range with consideration being given to the changing rotational speed and pressure loading of the machine also not being theoretically precisely possible. The uneven loading of the ball or roller bearings is the essential criterium for the high wear thereof.

2. Discussion of the Prior Art

Previously known hydraulically supported axial friction bearings are not suited for high rotational speeds, since they are sensitive to foreign bodies and temperature variations and produce a continuous oil leakage loss which reduces the efficiency of the machine. In order to avoid these disadvantages, from German Published Patent Application No. 1,210,681 it has become known to transmit without play only a portion of the occuring axial forces through roller bodies on a track fixed on the housing, while the remainder of the axial forces are hydrautically transmitted through radially or axially offset and yieldably arranged roller bearing tracks in dependence upon the working pressure of the drive fluid.

In the bearing support of the previously mentioned type which has become known from German Laid-open Patent Application No. 21 12 822, the two axially loadable bearings are constructed as radiax bearings, in effect, deep groove-type radial ball bearings, in order to relieve the higher loaded piston-sided radiax bearing from the axial components of the piston forces and to distribute on the parallel operating drive-sided radiax bearing; for transmission of the axial forces to the bearing housing, the drive shaft together with the drive disc and with a shoulder on the shaft is supported on the inner rings of the two radiax bearings which are provided with different diameters. For the distribution of the axial forces over the two bearings, the stationary outer ring of the drive-sided axial bearing is indirectly supported on the housing, whereas the larger diameter outer ring of the piston-sided axial bearing is positioned against a balancing piston which is subjected to the machine pressurized fluid.

This drive shaft bearing is constructively complicated since, due to the stepped construction of the drive shaft and of the housing inner wall, it requires precise tolerances and a high production demand. However, it is a significant disadvantage that, for the supply of the balancing piston with machine pressurized fluid, there is required a high pressure-resistant bearing housing through which, in a usual manner, the pressure-sided machine pressurized fluid is introduced through a passageway.

The same disadvantage encountered with respect to the required high pressure-resistant bearing housing is present in German Laid-open Patent Application No. 27 40 821 in the bearing support therein of principally the same type. Therein, balancing pistons lie against the outer ring of the drive-sided radial bearing. The inner ring of the piston-sided radiax bearing is supported by means of a spacer sleeve which is mounted on the drive shaft against the inner ring of the drive-sided radiax bearing. A further disadvantage of this solution consists of in that, ahead of the drive-sided radiax bearing, there is additionally required a sufficiently large constructional space for the balancing pistons. Inasmuch as for combined radiax bearings there is sought the largest possible bearing distance for the reduction of the radial forces, through consideration of the bearing length, the building space in this known solution cannot be utilized entirely in an optimum manner. Moreover, the supply with machine pressurized fluid must be effected over a lengthy path, in effect, from one end of the other of the entire axial piston machine.

SUMMARY OF THE INVENTION

Accordingly, it is an object of the present invention to provide a spatial arrangement for a drive shaft bearing support of the above-mentioned type through which the bearing length, in conformance with the constructive space for the optimum bearing spacing of the individual bearings, is not increased by the pressure cylinder unit and it is possible to supply the pressure cylinder unit in a simple manner without the necessity for a high pressure-resistant bearing housing.

In order to achieve the foregoing object there is inventively proposed that for a bearing support of the abovementioned type, the pressure cylinder unit be arranged between the inner rings of the bearing, whereby the balancing piston is located against one of the inner rings and a cylinder portion of the pressure cylinder unit is located against the other inner rings, and wherein the supply of the pressure chamber of the pressure cylinder unit with pressurized fluid is effected through a passageway within the drive shaft.

The measures achieve the desired objects while avoiding the above-mentioned disadvantages. It has been proven as especially advantageous for the load balancing between the two bearings that the unloading of the more highly loaded piston-sided bearing be undertaken directly at the inner ring thereof. Thereby, in an axial piston machine with a drum which is supported through the intermediary of a pressure-loaded or pressureless center journal, it is possible in a suitable embodiment of the invention that the passageway to the pressurized fluid supply in the drive shaft be connected with a passageway in the center journal, which in turn is connected through the control surface of the machine with the pressure side of the machine. This results in a constructionally simple solution for the infeed of the pressurized fluid to the balancing cylinder unit. A high pressure-resistant bearing housing is no longer required and the path for the pressurized fluid infeed is the shortest possible path within the machine.

The additionally required mechanical coordination of the bearing support for affording the satisfactory running operation in the pressureless condition of the machine is possible in a suitable embodiment of the invention, when the outer rings of the bearings are supported against each other by means of a spacer ring, and only the outer ring of the drive-sided bearing is supported on the bearing housing. When, in the pressureless condition of the machine, the balancing piston is supported directly on the cylinder component, in essence, the pressure chamber of the pressure cylinder unit has a zero volume, through a correlation of the spacer ring between the outer rings of the two bearings there can be adjusted the suitable play between the two bearings. This procedure is rendered easier in a further advantageous embodiment of the invention in that the drive-sided bearing is a bearing with a demountable outer ring.

BRIEF DESCRIPTION OF THE DRAWINGS

Reference may now be had to the following detailed description of an examplary embodiment of the invention, taken in conjunction with the single FIGURE of the accompanying drawings which schematically illustrates in section an axial piston machine having an inclined axis construction with the invention bearing support.

DETAILED DESCRIPTION

The schematically illustrated inclined axis, axial piston machine consists of a rotatable drive shaft 1 with a drive disc 2, which is driven through a drive (not shown), which drives the cylinder drum 5 through the intermediary of piston rods 3 and piston 4, and is arranged within a fixed or pivotable housing 6. On the side remote from the drive disc 2, the cylinder 5 runs on a control surface or disc member 7, through which the cylinder chambers 8, pursuant to the rotational position of the cylinder drum 5, connect with the pressure or suction-sided (pump) or to the exhaust-sided (motor) pressurized fluid passageways 9, 10.

The drive shaft 1 is supported within a bearing housing 11 through two bearings 12 and 13 which are arranged at an axial spacing, wherein the drive-sided bearing 12 as well as the piston-sided bearing 13, is constructed as a radiax bearing with equally directed cone angles extending towards the piston side. The bearings 12 and 13, in accordance with special requirements, can also be constructed as bearing combinations from axial and/or radial bearings. For the present invention it is only essential that the two bearings 12 and 13 are axially loadable bearing units with the same load receiving direction facing towards the piston.

The bearing 12 encompasses an outer ring 14 and an inner ring 15. The bearing 13 encompasses an outer ring 16 and an inner ring 17 which, at the piston side, is supported directly on the drive disc 2. The outer rings 14, 16 are fixedly arranged in the bearing housing 11 and axially supported against each other by a distance or spacer ring 18. Arranged between the inner rings 15 and 17 which are located on the drive shaft 1 is a pressure cylinder unit 19, consisting of a balancing piston 20 which is sealingly mounted on the drive shaft 1 and a cylinder portion 21 also sealingly arranged on the shaft 1. In the illustrated embodiment, the balancing piston 20 lies against the inner ring 15, and the cylinder portion 21 against the inner ring 17. The balancing piston 20 has different internal diameters so that the balancing piston 20 receives the cylinder portion 21 in its region with the larger inner diameter, and wherein a pressure chamber 22 is formed between the piston 20 and the cylinder portion 21.

The pressure chamber 22 of the pressure cylinder unit 19 is in communication with the pressure side of the machine through a central passageway 23 and a transverse passageway 24 formed in drive shaft 1 so that the pressure chamber 22 can be subjected to pressurized fluid. In the illustrated embodiment of the axial piston machine, the cylinder drum 5 is supported through a center journal 25, and by means of the spring 26 supported against the drive disc 2. Within the center journal 25 there is provided a passageway 27 which, on the one hand, is in communication with the passageway 23 in the drive shaft 1 and, on the other hand, is in communication through the control plate member 7 and through a T-passageway 28 with built-in non return valves 29, respectively with the pressure-conveying passageway 9 or 10 for the operating fluid of the axial piston machine. Provided for sealing in connection with the control plate member 7 and the housing cover 30 is an axially sealing piston shoe or runner 31.

The means 32 for the drive-sided axial positioning of the outer ring 14 of the bearing 12 are not described in detail herein and can be of usual known construction. It is merely essential that the outer ring 14 be constructed so as to be demountable so that, at a demounted outer ring 14, there can be built in the spacer ring 18 over the bearing roll members of the bearing 12. Rendered easier thereby is the axial correlation of the bearings 12 and 13 so as to afford a problemless running even in the pressureless condition. The selection of the length of distance or spacer ring 18 required for the correlation is undertaken with the piston 20 supporting against the cylinder portion 21, which means that when the pressure chambeer 22, which is illustrated as a gap, becomes zero.

What is claimed is:

1. In a bearing support for the drive shaft of an axial piston machine of an inclined axis construction for pressurized fluids, including at least one piston-sided and one drive-sided axially loadable bearing having stationary outer rings arranged in a bearing housing and of equal load receiving direction towards the piston side, at least the outer ring of one of the bearings being axially supported on the bearing housing and at least one of the inner rings of said bearing being supported on the piston side against the drive shaft; at least one pressure cylinder unit having a balancing piston and subjected to pressurized fluid from the pressure side of the machine for balancing the effective axial components of the piston forces between the bearings; the improvement comprising: said pressure cylinder unit being arranged intermediate the inner rings of said bearings, said balancing piston being located against one of said inner rings and a cylinder portion of said pressure cylinder unit being located against the other inner ring; and a passageway in said drive shaft for supplying the pressure chamber of said pressure cylinder unit with pressurized fluid.

2. Support as claimed in claim 1, comprising a drum; a pressure-loaded or pressureless center journal supporting said rum; a passageway in said center journal being connected with the passageway in said drive shaft and being connected through the control plate member of said machine with the pressure side of said machine.

3. Support as claimed in claim 1 or 2, comprising a spacer ring for supporting the outer rings of said bearings against each other, the outer ring of only the drive-sided bearing being axially supported on the bearing housing.

4. Support as claimed in claim 3, said drive-sided bearing comprising a bearing having a demountable outer ring.

5. Support as claimed in claim 1, said balancing piston being a ring piston having varying internal diameters and being sealingly mounted on said drive shaft; a cylinder ring being arranged in the region of said ring piston having large internal diameters and being sealingly supported relative to the balancing piston and the drive shaft; the pressure chamber formed intermediate the balancing piston and the cylinder ring including a transverse passageway in direct communication with the central passageway for the pressurized fluid in said drive shaft.

* * * * *